United States Patent [19]

Sperrazza et al.

[11] 4,451,178

[45] May 29, 1984

[54] METHOD FOR DISPERSING OR ARRESTING LAVA FLOW

[75] Inventors: Joseph Sperrazza, Aberdeen; James C. C. Liu, Bel Air, both of Md.; Wilfred E. Baker, San Antonio, Tex.

[73] Assignee: The United States of America as represented by the Secretary of the Army, Washington, D.C.

[21] Appl. No.: 285,889

[22] Filed: Jul. 21, 1981

[51] Int. Cl.³ ..... E02D 3/00; A62C 37/00

[52] U.S. Cl. ..... 405/258; 169/56

[58] Field of Search ..... 405/258, 115; 169/36, 169/54, 56, 64; 52/1

[56] References Cited

U.S. PATENT DOCUMENTS

| | | | |
|---|---|---|---|
| 1,878,490 | 9/1932 | Goss . | |
| 1,968,993 | 8/1934 | Cox | 405/258 |
| 2,857,971 | 10/1958 | Ferris . | |
| 3,173,269 | 3/1965 | Imbertson | 405/115 X |
| 3,719,231 | 3/1973 | Haggard | 169/56 X |
| 3,749,016 | 7/1973 | Hershkowitz . | |
| 3,878,897 | 4/1975 | Goffart . | |
| 3,918,526 | 11/1975 | Hattori et al. . | |
| 4,009,622 | 3/1977 | Hinderks . | |

*Primary Examiner*—Cornelius J. Husar
*Assistant Examiner*—Nancy J. Stodola
*Attorney, Agent, or Firm*—Darrell E. Hollis

[57] ABSTRACT

The method of diverting a lava flow including the steps of positioning for filling a vessel, explosive under high temperature and pressure, at least partially filling the vessel with a nonflammable composition, stable at normal temperature and convertible to gas under high temperature allowing room within the vessel for expansion of the composition if frozen, tightly sealing the vessel to prevent loss of the composition, positioning in a volcanic region in the normal expected path of a lava flow in a specific area, which will cause the lava flow to be diverted from certain geographic locations upon explosion of the vessel, whereby when a lava flow occurs in the volcanic region and flows over the vessel, the vessel will heat up to temperatures in excess of 1000° F. causing the composition to be converted into gas and the vessel to gradually pressurize as heat builds up and subsequently to explode at a desired temperature and pressure thereby causing sufficient explosive force so as to divert the lava flow into a new channel.

16 Claims, 5 Drawing Figures

METHOD FOR DISPERSING OR ARRESTING LAVA FLOW

STATEMENT OF GOVERNMENT INTEREST

The invention described and claimed herein may be manufactured and used by or for the Government of the United States of America for governmental purposes without the payment of royalties thereon or therefor.

This invention relates to methods for diverting the flow of lava away from populated or important geographical areas by positioning containers or vessels having an inert or nonexplosive fluid therein, or similar material which may be solid or semi-solid. The vessel is designed so that it will explode under very high pressure, which pressure can be developed within the vessel by positioning the vessel in an area which may be subject to extremely high temperatures so as to cause the material within the vessel to vaporize and create pressures sufficient to cause an explosion of large magnitude due to the sudden release of tremendous pressure forces built up therein.

BACKGROUND OF THE INVENTION

A significant proportion of populated regions around the world lie within geographical areas known to be unstable due to volcanic activity. Technology in the field of monitoring of regions having the potential for volcanic activity has progressed rapidly and effectively within recent years. With this new technology at hand, scientists have the capability of quite accurately predicting volcanic eruptions before they actually occur.

The potential for large scale fatality and property damage is greatest in those populated areas within close proximity to the source of the volcanic disturbance. While evacuation of the population may be an effective means for reducing the number of casualities, widespread property damage due to the flow of molten lava into the residential areas has been virtually unchecked.

The use of powerful chemical explosives positioned in advance of the lava flow which are subsequently detonated in order to divert the flow of lava away from populated geographical areas is one possible solution.

Several critical drawbacks associated with the use of chemical explosives in the manner described above must be considered. Of primary concern are the safety hazards involved with the use of chemical explosives. Conventional explosives tend to "cook off" or prematurely explode before effective use at temperatures far below typical lava temperatures of 1800° F. and above. In addition conventional explosives generally require the use of fuses or other detonation devices in conjunction therewith.

In using explosive chemicals, there is always the likelihood of accidental detonation since most explosives become unstable due to aging, combining with other atmospheric compounds caused by pollution or by oxidation. In addition, accidental detonation may result from casual vibration or upon impact of the container by machinery or other type equipment. Further, the danger exists of placing explosive charges in areas where the containers might be found by children or unknowing adults who innocently pick them up and accidently trigger the explosive causing harm to themselves or property.

OBJECTS AND SUMMARY OF THE INVENTION

It is therefore an object of the present invention to divert lava flows away from important geographical regions without the use of potential hazardous conventional chemical explosives.

Another object of the present invention is to provide a method of diverting lava flows using nonexplosive means which will vaporize and pressurize the container to cause the container in which they are held to explode at predetermined pressures and temperatures.

A further object of the invention is to provide a method for diverting lava flows which does not produce atmospheric pollution.

Still another object of the present invention is to provide a method for diverting lava flows which utilizes an ordinarily nonexplosive, easily handled and transported device, which substantially reduces the possibility of premature detonation.

Still another object of the present invention is to provide a device having anchoring means for maintaining proper positioning within the lava flow.

Still another object of the present invention is to provide a device having ejector means for forcing the ordinarily nonexplosive device to the surface and into the flow of lava when predetermined subterranean temperatures are attained.

Still another object of the present invention is to provide a method for diverting lava flows which requires a minimum of preparation time and expense in order to carry out.

Yet another object of this invention is to provide a device for use in halting or redirecting lava flows which is inexpensive and easy to manufacture.

In summary this invention involves the positioning of vessels containing water or other compositions at critical locations in predicated lava flow areas which will explode at the high temperatures of molten magma to cause a diversion of the lava flow.

These and other objects and advantages of this invention will be apparent from the following description and claims.

DESCRIPTION OF THE DRAWINGS

In the accompanying drawings which illustrate by way of example various embodiments of this invention.

DETAILED DESCRIPTION OF THE INVENTION

Figure 1:
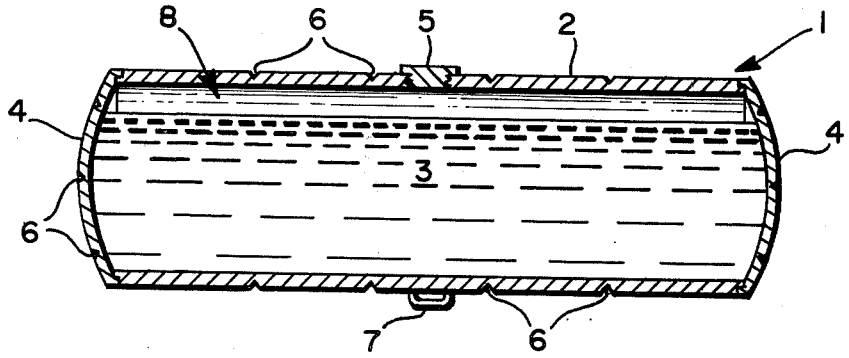
FIG. 1 is a cross-sectional view of a typical container used in this invention.

As shown in FIG. 1, a vessel 1 is comprised of a casing 2, which is partially filled with a nonflammable composition 3. Caps 4 are threadedly engaged onto the ends of casing 2. Casing 2 may have a threaded opening into which a threaded plug member 5 is screwed. In order to prevent excessive fragmentation upon explosion, the exterior of vessel 1 is provided with grooves 6. Handle 7 is attached to vessel 1 in order to provide means for attaching a tether, as will be described later. In the event that vessel 1 is subjected to frigid conditions, wherein composition 3 contained therein freezes, an expansion room 8 is provided.

Vessel 1 may be in the shape of a cylinder as shown in FIG. 1, or it may assume spherical configuration. In terms of ease and reduced cost in manufacturing, the cylinder configuration is preferable to the sphere. Vessel 1 should be made of a high strength material which retains its strength to a high temperature until a predetermined rupture or fragmenting point is attained. Steel is the preferred material since it fulfills the above strength requirements. In addition, steel can also be readily welded, machined, or worked in any other manner for rapid fabrication. Other more exotic ceramic materials which actually strengthen with increased temperatures are available, however, they are generally quite expensive and difficult to form into pressure vessels regardless of size.

Nonflammable composition 3 may be a fluid, semifluid, or solid. Typical compositions for use would be water, alcohol, jelly type plastics or solid type plastics including mixes, which will be vaporized at high temperatures. Water is the preferable liquid composition to be used within vessel 1, due to its availabilty and low cost. In terms of safety, water is extremely stable under normal conditions so that accidental detonation due to shock or other handling procedures is virtually eliminated.

Figure 2:
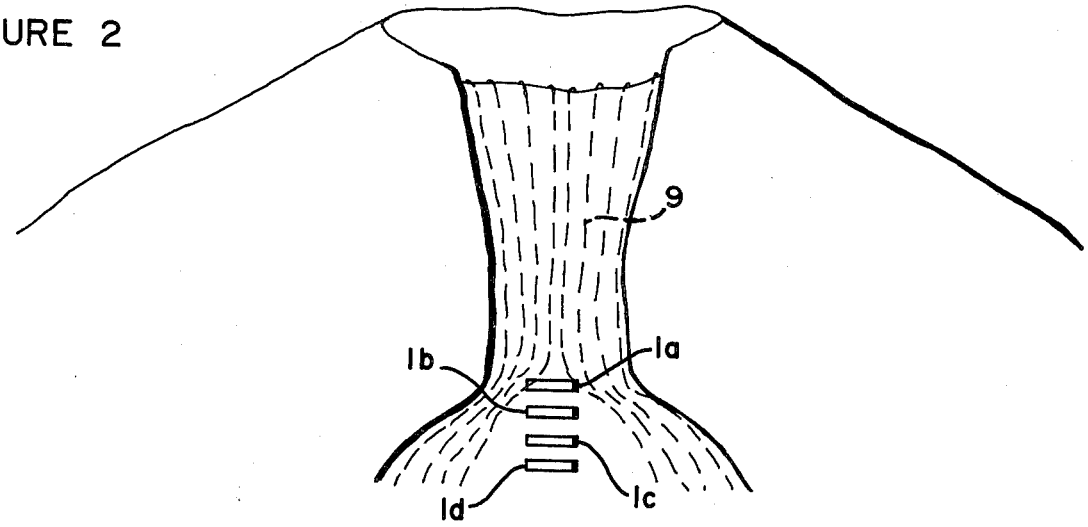
FIG. 2 is a schematic view of a plurality of explosive vessels positioned in sequence in advance of the main flow of lava.

As shown in FIG. 2, a plurality of fluid filled vessels 1*a*, 1*b*, 1*c* and 1*d* may be positioned in sequence in advance of lava flow 9. The use of a plurality of vessels is two fold. First, it provides insurance in that in the event that one or more of the preceding vessels fails to explode, there are backups. Secondly, such positioning provides multiple explosions in the instance where the preceding vessel fails to sufficiently divert the lava flow.

The explosive vessel or vessels 1 should be positioned in a specific area which will ensure proper diversion of lava flow 9. This may be accomplished by careful placement in the vicinity of naturally occurring geographical formation such a troughs or crevices, or in proximity to man-made channels, so that upon explosion of vessel or vessels 1, the lava flow will be suitably diverted there into.

Figure 3:
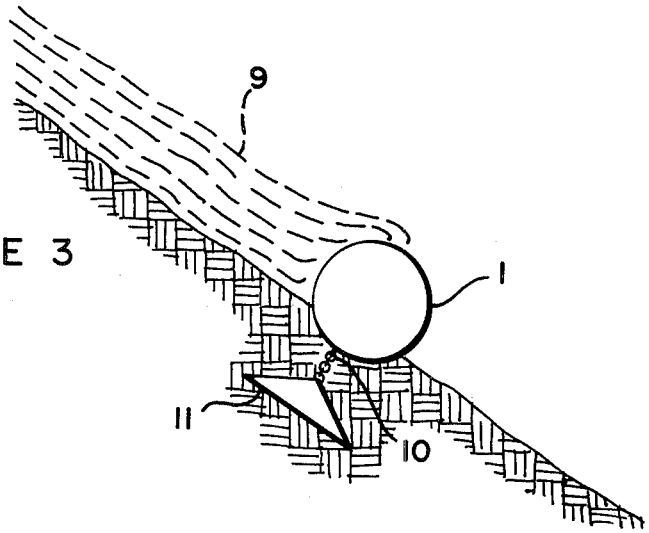
FIG. 3 is a schematic view showing the explosive device positioned in advance of the lava flow and secured in place by anchoring means positioned in the subterranean.

As shown in FIG. 3, vessel 1 is immobilized by tether 10 connected to anchor 11. Tether 10 is attached to handle 7 of vessel 1. Anchor 11 should be of a suitable shape so that it will not be displaced as lava 9 flows over vessel 1. Displacement may be prevented by providing anchor 11 with an enlarged base member. Preferred shapes for anchor 11 are pyramidal and frusto-conical. In addition, anchor 11 should be buried at a sufficient depth in order for it to be effective.

Figure 4:
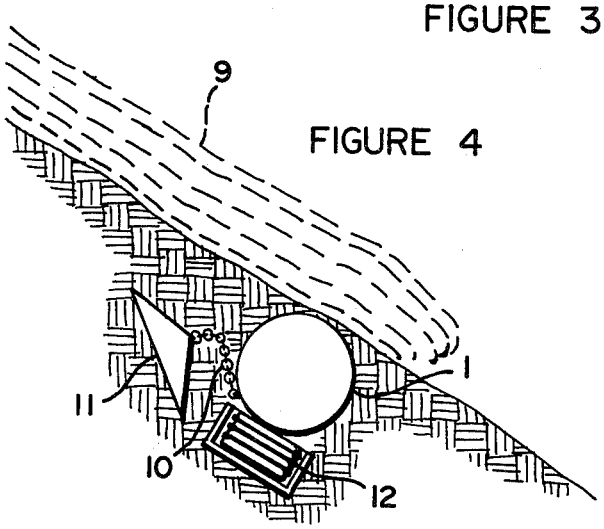
FIG. 4 is a schematic view showing the explosive device positioned and anchored below the surface of the earth and having means for ejecting the explosive device above ground and into the flow of lava.

In the embodiment as shown in FIG. 4, vessel 1 may be positioned below ground in close proximity to the surface. Ejector means 12 are provided for forcing vessel 1 through the ground surface into the flow of lava 9. Ejector means 12 may simply be a spring which is maintained in compression by a material fusible at temperatures well below that of lava flow 9. Where the fusible material used is solder, heat generated by lava 9 is sufficient to heat up the surrounding ground to a temperature capable of melting the solder, thereby releasing the spring from its compressed state and subsequently ejecting vessel 1 into lava flow 9.

Figure 5:
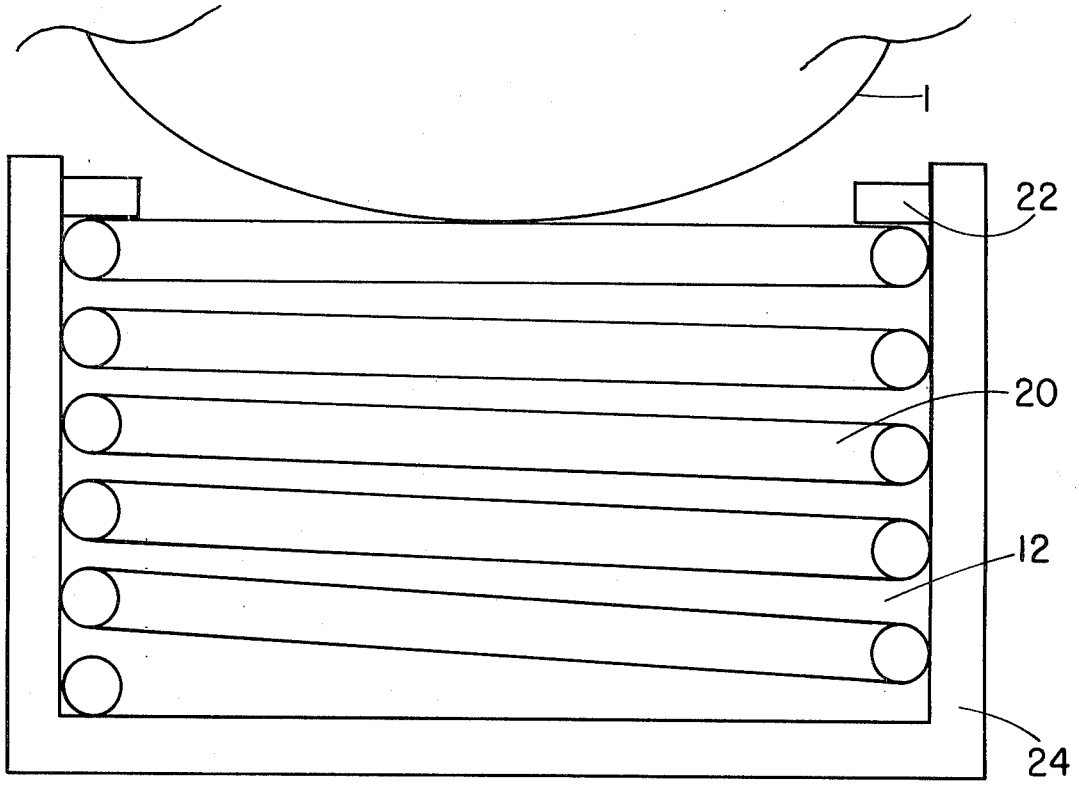

As shown in FIG. 5, ejector means 12 includes a spring 20 held in compression by means of solder stops 22. Solder stops 22 are rigidly afixed to container 24 projecting inwardly therefrom to provide a shoulder or stop for retaining spring 20 in compression within container 24. When hot lava heats the ground surrounding solder stops 22 to a temperature sufficient to melt the solder, spring 20 in released thereby ejecting vessel 1 into the lava flow. Of course other more elaborate means capable of being triggered by a fusible material may be employed to maintain spring 20 in compression. Again, vessel 1 is connected to anchor 11 by tether 10 which is of sufficient length to allow vessel 1 to reach above ground. Below ground positioning serves the purpose of preventing premature heating and exploding of vessel 1 until a sufficient quantity of lava has reached its placement position. When prepositioned at a time well in advance of an anticipated eruption, below ground placement reduces the possibility of accidental impact by machinery or tampering by individuals of vessel 1.

The method for diverting the flow of molten lava from a volcanic eruption in general includes the following steps. To begin with, vessel 1 is positioned for filling with a nonflammable composition 3 such as fluid, semifluid, or solid. As an example, vessel 1 may be positioned below a dispenser so that composition 3 may be dispensed by gravity thereinto.

Next, vessel 1 is partially filled with nonflammable composition 3 which is convertible to gas under high temperature. As mentioned above, water is the prefered composition. Composition 3 may be dispensed into vessel 1 through the opening in which plug 5 is seated. Room 8 is provided within vessel 1 in order for expansion of composition 3 in cases where vessel 1 is subjected to frigid conditions wherein composition 3 freezes.

The next step involves tightly sealing vessel 1 to prevent any loss of composition 3 contained therein. Plug 5 is screwed into the opening in casing 2 to provide a suitable seal. In addition, in order to assure a proper seal, welding techniques may also be utilized. The sealing procedure is normally accomplished at atmospheric pressure in order to reduce expense, however in certain situations it may be preferable to seal vessel 1 under conditions of sub and super atmospheric pressures.

The next step involves positioning one or more vessels 1 in a volcanic region in the normal expected path of lava flow 9 and in a specific area, which will cause lava flow 9 to be diverted from certain geographic locations upon the explosion of vessel or vessels 1, whereby when lava flow 9 occurs in the volcanic region and flows over the vessel or vessels 1, the vessel or vessels 1 will heat up to temperatures of 1000° F. or more causing composition 3 to be converted into gas and vessel or vessels 1 to gradually pressurize as heat builds up and subsequently explode at a desired temperature and pressure thereby causing sufficient explosive force so as to divert lava flow 9 into a new channel.

The explosive vessel or vessels 1 should be placed in a specific area which will ensure proper diversion of lava flow 9. This may be accomplished by careful placement in the vicinity of naturally occurring geological formations such as troughs or crevices, or in proximity to man-made channels so that upon explosion of vessel or vessels 1, lava flow 9 will be suitably diverted thereinto.

Typically, vessel 1 should be designed to explode at temperatures above 1000° F. and preferably above 1500° F. to 1800° F. In general, the size of vessel 1 is determined by the amount of explosive force required to divert a large segment of lava flow 9. Large pressure vessels of the size of gasoline storage tanks could readily be used.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

We claim:

1. The method of diverting lava flow including the steps of:
   (a) positioning for filling, a high pressure vessel explosive under extremely high pressure,
   (b) at least partially filling said vessel with a nonflammable composition, liquid at normal temperatures and convertible to gas under high temperature, allowing room within said vessel for expansion of said composition if frozen,
   (c) tightly sealing said vessel to prevent loss of said composition,
   (d) positioning said vessel in a volcanic region, in a specific predetermined locale in the normal expected channel of a lava flow,
   (e) whereby when a lava flow occurs in said volcanic region and flows over said vessel, said vessel will heat up to temperatures of at least 1000° F. or more causing said composition to be heated and converted into gas thereby presurrizing said vessel to a desired exploding pressure, causing said vessel to explode with sufficient force so as to divert said lava flow from its normal channel into a new channel and away from a predetermined geographical area.

2. The method for diverting a lava flow as in claim 1, wherein:
   (a) the step of partially filling said vessel with a nonflammable composition includes partially filling said vessel with water.

3. The method of diverting a lava flow as in claim 1, wherein:
   (a) the step of tightly sealing said vessel includes the step of tightly sealing said vessel at atmospheric pressure.

4. The method of diverting a lava flow as in claim 1, wherein:
   (a) the step of positioning said vessel in a volcanic region in a specific predetermined locale includes the step of positioning said vessel above ground and anchoring said vessel in place.

5. The method of diverting a lava flow as in claim 1, wherein:
   (a) the step of positioning said vessel in a volcanic region in a specific predetermined locale includes the step of positioning said vessel below ground and anchoring said vessel in place.

6. The method of diverting a lava flow as in claim 5 including the step of:
   (a) ejecting said vessel from below ground into said lava flow upon said vessel reaching a predetermined temperature.

7. The method of diverting a lava flow as in claim 1, wherein:
   (a) the step of positioning said vessel in a volcanic region in a specific predetermined locale includes the step of positioning a plurality of similar vessels in series to cause a series of explosions in a predetermined geographical area.

8. The method of diverting a lava flow as in claim 1, wherein:
   (a) said temperature for causing said exploding pressure in said vessel is between about 1500° F. and about 1800° F.

9. A ground positioned device for diverting the flow of lava incuding:
   (a) a closed vessel, capable of withstanding a high internal pressure;
   (b) said vessel including a nonflammable composition at least partially filling said vessel;
   (c) means for anchoring said vessel in the ground;
   (d) means for projecting said vessel upwardly into said lava flow when said vessel is positioned below the surface of the ground; and
   (e) temperature control release means for said projecting means.

10. A ground positioned device as in claim 9 and wherein:
   (a) said composition is $H_2O$ liquid.

11. A ground positioned device as in claim 9 and including:
   (a) an airspace in said vessel.

12. A ground positioned device as in claim 11 and wherein:
   (a) said airspace is sufficient to receive expanded $H_2O$ composition should said $H_2O$ composition be converted from liquid into a solid by freezing, thereby to prevent fracturing of said vessel by freezing pressures within said vessel.

13. A ground positioned device as in claim 9 and wherein:
   (a) said projecting means include a coil spring.

14. A ground positioned device as in claim 13 and wherein:
   (a) said temperature control release means for said projecting means include a high temperature melting solder.

15. A ground positioned device as in claim 14 and wherein:
   (a) said coil spring is normally under compression and
   (b) said solder maintains said coil spring under compression at below said high melting temperature.

16. The ground positioned device of claim 9 wherein anchoring means includes,
   (a) an anchor; and
   (b) a tether connected between said anchor and said vessel.

* * * * *